US006998780B2

(12) United States Patent
Matsumoto et al.

(10) Patent No.: US 6,998,780 B2
(45) Date of Patent: Feb. 14, 2006

(54) PLASMA DISPLAY PANEL

(75) Inventors: Tetsuya Matsumoto, Yamanashi (JP); Chiharu Koshio, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 146 days.

(21) Appl. No.: 10/781,909

(22) Filed: Feb. 20, 2004

(65) Prior Publication Data

US 2004/0217708 A1 Nov. 4, 2004

(30) Foreign Application Priority Data

Feb. 20, 2003 (JP) ..... P.2003-042002

(51) Int. Cl.
*H01J 17/49* (2006.01)

(52) U.S. Cl. ..... 313/582; 313/583

(58) Field of Classification Search ..... 313/582–586
See application file for complete search history.

(56) References Cited

U.S. PATENT DOCUMENTS 6,229,504 B1 * 5/2001 Andreev et al. ..... 345/60

FOREIGN PATENT DOCUMENTS

JP 3084048 B2 6/2000

* cited by examiner

*Primary Examiner*—Vip Patel

(74) *Attorney, Agent, or Firm*—Sughrue Mion, PLLC

(57) ABSTRACT

A plasma display panel includes a pair of substrates disposed to face each other, with a discharge space sandwiched therebetween; plural surface-discharge electrode pairs comprising scanning electrodes and common electrodes formed at an inner surface of the front substrate (one of the pair of substrates); and a dielectric layer covering the surface-discharge electrode pairs with respect to the discharge space. Extraction electrode portions of the scanning electrodes are led to an end portion of one side of the front substrate. Extraction electrode portions of the common electrodes are led to an end portion of the other side of the front substrate. An island-shaped assembly electrode terminal portion that commonly connects the extraction electrode portions of the common electrodes is disposed. Plural micro openings are defined in the assembly electrode terminal portion to form a mesh.

5 Claims, 5 Drawing Sheets

PLASMA DISPLAY PANEL

The present disclosure relates to the subject matter contained in Japanese Patent Application No. 2003-42002 filed on Feb. 20, 2003, which is incorporated herein by reference in its entirety.

BACKGROUND OF THE INVENTION

1. Field of the Invention

The present invention relates to a plasma display panel.

2. Description of the Related Art

FIG. 1 is a diagram showing an example of an electrode structure of a plasma display panel in the related art. A surface-discharge type dot matrix display-format plasma display panel (PDP1) includes a display-side glass substrate 110 and a back-side glass substrate 120, which are disposed facing each other with a predetermined gap therebetween.

In FIG. 1, plural pairs of main discharge electrodes 111, which determines a main discharge cell for emitting light, are aligned as display electrodes so as to be parallel to each other in a horizontal (X) direction. Address electrodes 122 for selecting dots made to emit light are aligned in a vertical direction (Y) at an inner surface of the back-side glass substrate 120.

The main discharge electrodes 111 and the address electrodes 122 are led, from inside a display region E1 enclosed by a sealing glass 132, to outer edge portions of the glass substrates 110 and 120. Particularly in the PDP1, in order to facilitate connection with drive circuits, one of the main discharge electrodes 111 of each pair and the other of the pair are sorted and led to the outer edge portions of both sides of the glass substrate 110. Terminal portions 111*a*, 111*b*, 122*a* and 122*b*, at which the main discharge electrodes 111 and the address electrodes 122 are expanded, are disposed at the outer edge portions of each of the glass substrates 110 and 120 in order to connect them to unillustrated drive circuits using a flexible cable or the like (Japanese Patent No. 3084048 (page 3 and FIG. 5)).

One of the main discharge electrodes 111 of each pair (surface-discharge electrode pairs) described in the aforementioned prior art is a common electrode and the other of the pair is a scanning electrode. The terminals (111*a* in FIG. 1) of the outer edge portion of the plural common electrodes are independent terminals similar to the terminals (111*b* in FIG. 1) of the outer edge portion of the plural scanning electrodes.

However, when the terminals of the common electrodes are made into respectively independent terminals, as in the aforementioned conventional plasma display panel, there is the potential for differences in luminance to arise between display lines. It is conceivable to commonly connect extraction electrode portions of the common electrodes to a wide solid electrode (island-shaped assembly electrode terminal portion) in order to eliminate this. However, when the terminal portions of the common electrodes are made into a solid electrode, there is the potential for cracks to form—e.g., the terminal portions are vertically segmented by these cracks—in the terminal portions and for a difference in luminance to arise between the upper and lower screens.

SUMMARY OF THE INVENTION

Eliminating the problem occurring in the aforementioned prior art can be given as one example of the problem that the invention attempts to solve, and it is an object of the invention to provide a plasma display panel that can improve the reliability of extraction terminal portions of common electrodes.

According to an embodiment of the invention, a plasma display panel includes a pair of substrates, a plurality of surface-discharged electrode pairs, and a dielectric layer. The pair of substrates are disposed to face each other, with a discharge space sandwiched therebetween. The plurality of surface-discharge electrode pairs include scanning electrodes and common electrodes formed at an inner surface of one of the pair of substrates. The dielectric layer covers the surface-discharge electrode pairs with respect to the discharge space, wherein. Extraction electrode portions of the scanning electrodes are led to an end portion of one side of the one substrate. Extraction electrode portions of the common electrodes are led to an end portion of the other side of the one substrate. An island-shaped assembly electrode terminal portion that commonly connects the extraction electrode portions of the common electrodes is disposed. A plurality of micro openings are defined in the assembly electrode terminal portion.

DETAILED DESCRIPTION OF THE PREFERRED EMBODIMENT

An embodiment of the invention will be described below on the basis of the drawings.

This embodiment is a surface-discharge type plasma display panel in which a display-side front substrate and a back-side back substrate are disposed facing each other with a discharge space sandwiched therebetween. The structure of surface-discharge electrode pairs thereof will be described in detail below with reference to FIGS. 2 to 5.

Figure 1:
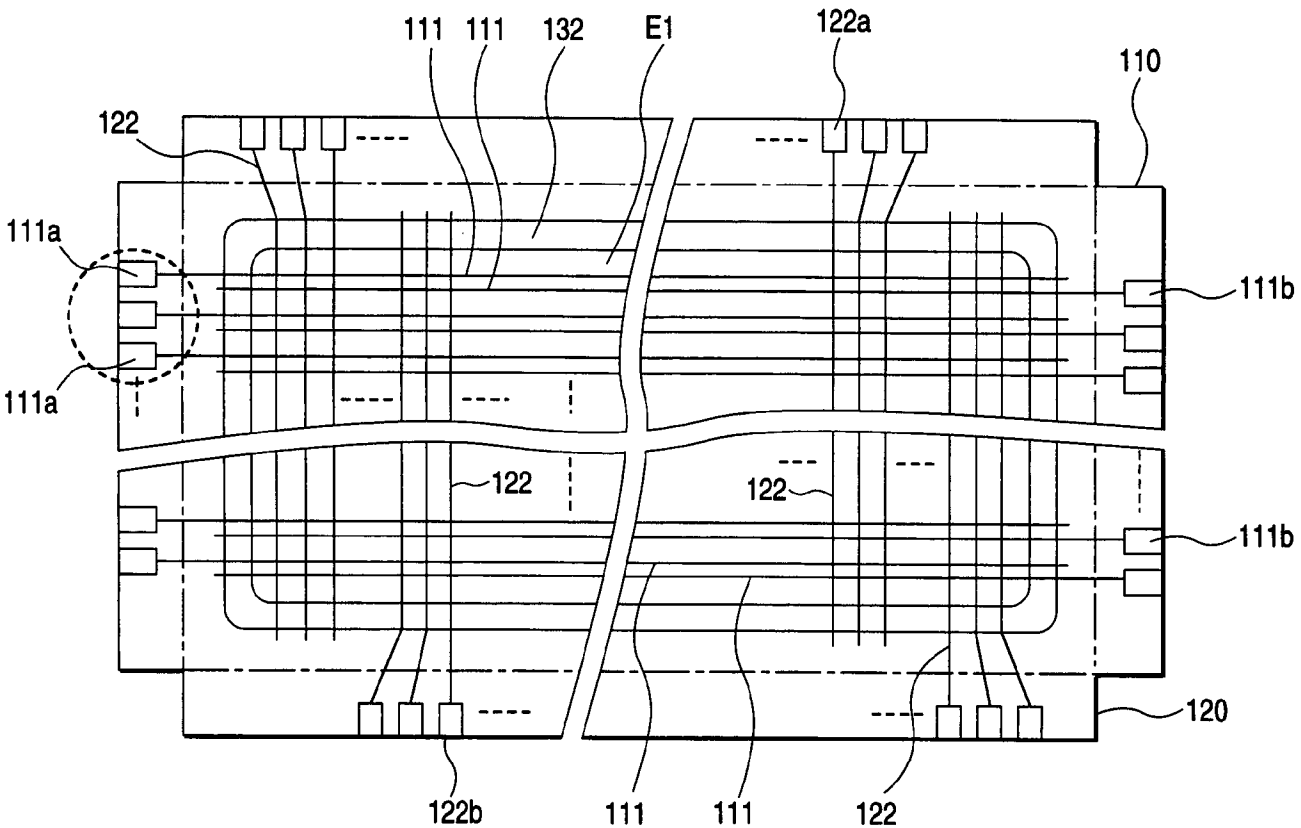
FIG. 1 PRIOR ART
FIG. 1 is a diagram showing an example of an electrode structure of a conventional plasma display panel.
Figure 2:
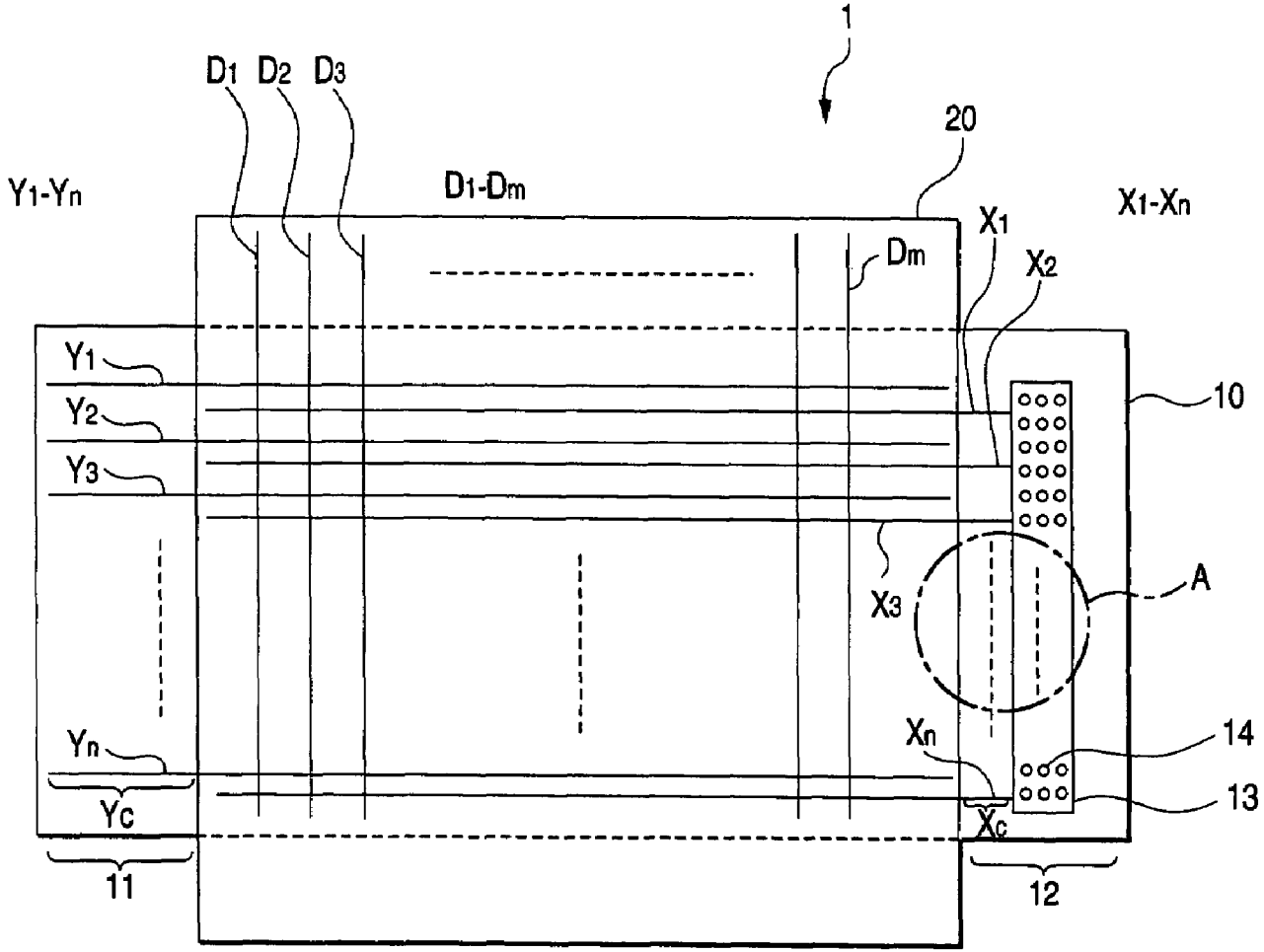
FIG. 2 is a diagram schematically showing an electrode structure of a plasma display panel of an embodiment pertaining to the invention.
Figure 3:
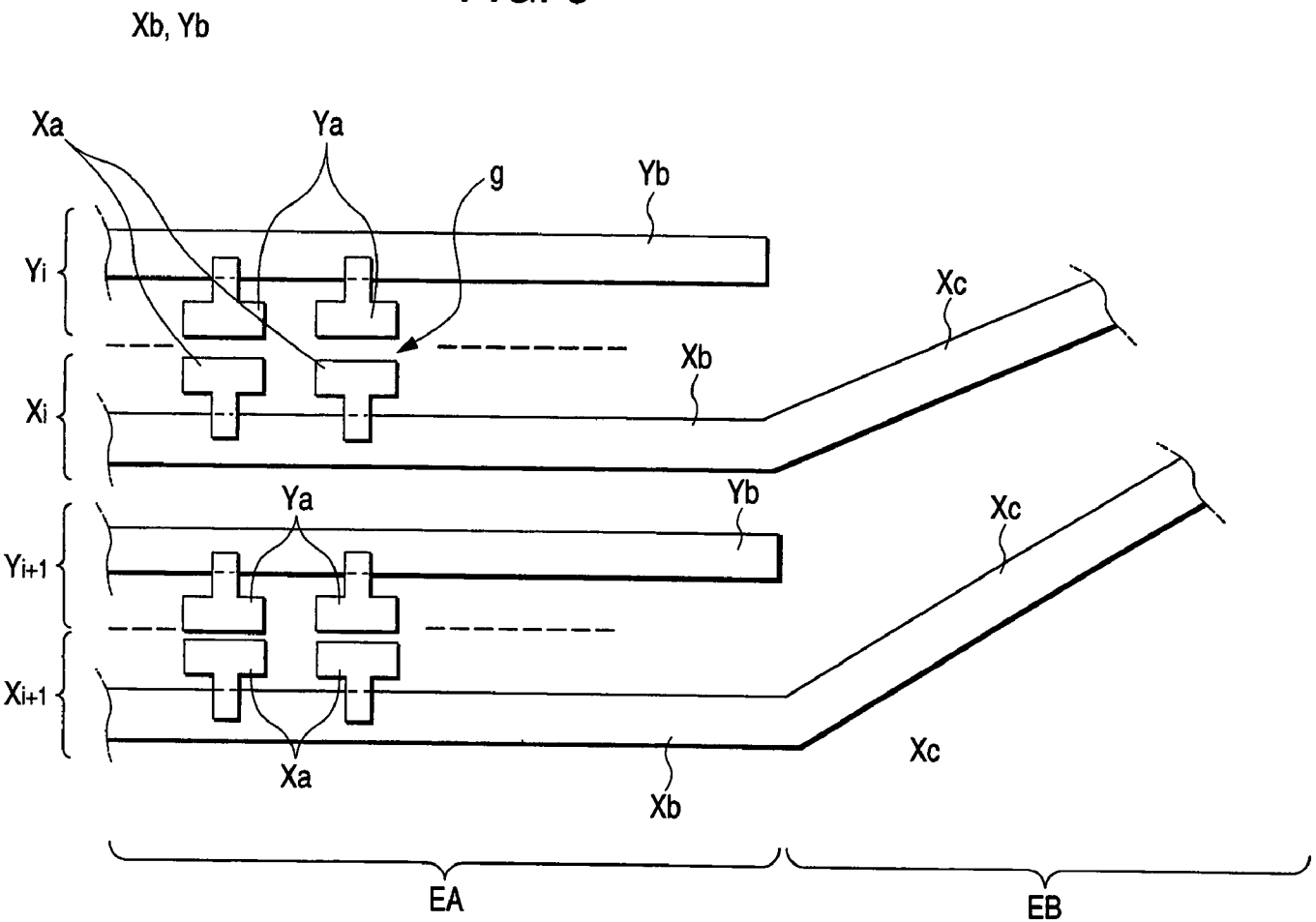
FIG. 3 is a diagram showing the structure of surface-discharge electrode pairs (common electrodes and scanning electrodes) of FIG. 2.
Figure 4:
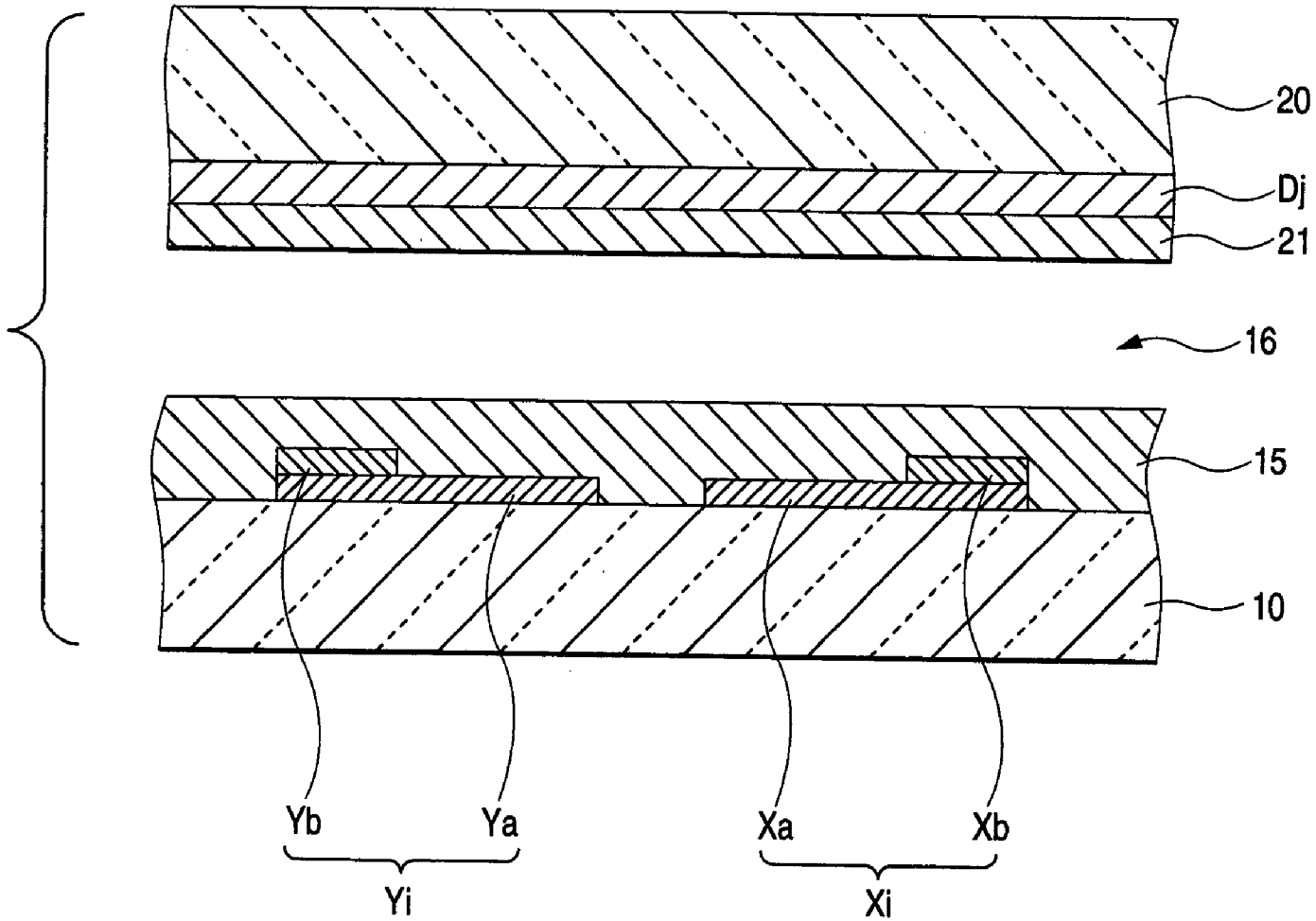
FIG. 4 is a diagram showing the cross-sectional structure of FIG. 2.
Figure 5:
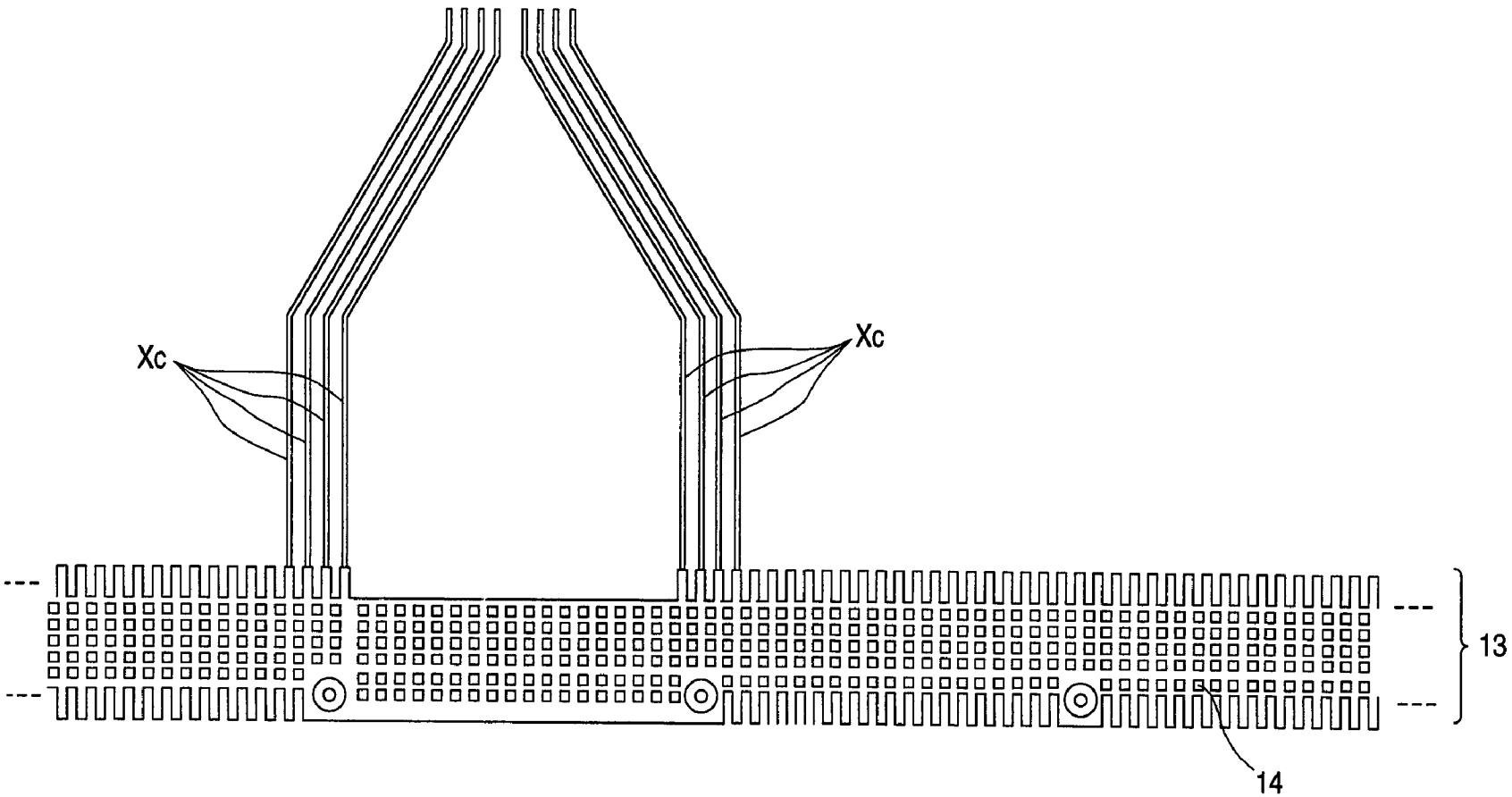
FIG. 5 is an enlarged diagram of an A portion of FIG. 2.

FIG. 2 is a diagram schematically showing an electrode structure of the plasma display panel of the embodiment of the invention. FIG. 3 is a diagram showing the structure of surface-discharge electrode pairs (common electrodes and scanning electrodes) of FIG. 2. FIG. 4 is a diagram showing the cross-sectional structure of FIG. 2. FIG. 5 is an enlarged diagram of an A portion of FIG. 2.

As shown in FIG. 2, in a display area EA of a plasma display panel 1, plural surface-discharge electrode pairs (common electrodes X1 to Xn and scanning electrodes Y1 to Yn) are aligned in parallel on a back surface of a front substrate 10, which is a display surface, so as to extend in a row direction (left and right directions in FIG. 2) of the front substrate 10.

Moreover, the structure of the surface-discharge electrode pairs (common electrodes and scanning electrodes) will be described in detail with reference to FIG. 3. Bus electrode portions Xb, which includes a metal film, of each common electrode Xi (i: 1 to n) are connected to narrow base end portions of transparent electrode portions Xa including a transparent conductive film such as ITO (Indium Tin Oxide) formed in a "T" shape. Bus electrode portions Yb of each scanning electrode Yi (i: 1 to n) are similarly connected to narrow base end portions of transparent electrode portions Ya including a transparent conductive film such as ITO formed in a "T" shape.

The bus electrode portions Xb of the common electrodes Xi and the bus electrode portions Yb of the scanning electrodes Yi are alternatingly aligned in a column direction (up and down directions in FIG. 3) of the front substrate 10. The respective transparent electrode portions Xa and Ya, which are juxtaposed along the bus electrode portions Xb and Yb, extend toward counterpart electrode sides so that top sides of wide portions of the transparent electrode portions Xa and Ya respectively face each other via a discharge gap g of a predetermined width.

Also, the common electrodes X1 to Xn and the scanning electrodes Y1 to Yn are configured so that extraction electrode portions Xc and Yc are led from inside the display area EA to non-display areas EB of outer edges of the front substrate 10, and the respective extraction electrode portions Xc and Yc of the common electrodes X1 to Xn and the scanning electrodes Y1 to Yn are respectively led to end portions of mutually different sides of the front substrate 10 (in FIG. 2, the extraction electrode portions Xc of the common electrodes X1 to Xn are led to a right-side end portion 12 and the extraction electrode portions Yc of the scanning electrodes Y1 to Yn are led to a left-side end portion 11).

As shown in the cross-sectional diagram of FIG. 4, a dielectric layer 15 covers the surface-discharge electrode pairs (the common electrodes Xi and the scanning electrodes Yi) formed on the back surface of the front substrate 10.

As shown in FIG. 2, address electrodes D1 to Dm for selecting dots made to emit light are aligned in the vertical direction on an inner surface of a back substrate 20 disposed parallel to the front substrate 10. As shown in the cross-sectional diagram of FIG. 4, an address electrode Dj (j: 1 to m) is covered by a dielectric layer 21 and disposed facing the front substrate 10 with a discharge space 16 sandwiched therebetween.

Moreover, as shown in FIG. 5, in which the A portion of the right-side end portion 12 in FIG. 2 has been enlarged, the extraction electrode portions Xc of the common electrodes X1 to Xn are commonly connected to an island-shaped assembly electrode terminal portion 13 at the right-side end portion 12, in which plural micro openings 14 are formed in a wide solid electrode.

The extraction electrode portions Yc of the scanning electrodes Y1 to Yn are independent terminals and formed at the left-side end portion 11 so as to be connectable to external circuits.

An example of a method for forming the surface-discharge electrode pairs of the plasma display panel of the embodiment pertaining to the invention will be described below.

First, ITO is solidly vapor-deposited on the front substrate 10 and patterned by photolithography to form the transparent electrode portions Xa and Ya.

Next, a conductive sheet, in which a conductive paste including metal power such as silver is made into a sheet, is transferred, patterned by photolithography and heated to simultaneously form the bus electrode portions Xb and Yb, the extraction electrode portions Xc and Yc and the island-shaped assembly electrode terminal portion 13 in which the plural micro openings 14 are formed.

Next, a dielectric film, in which a glass paste including low-melting glass powder is made into a sheet, is transferred and heated to form the dielectric layer 15.

The plasma display panel 1 of this embodiment includes the pair of substrates 10 and 20 disposed so as to face each other, with the discharge space 16 sandwiched therebetween; the plural surface-discharge electrode pairs including the scanning electrodes Yi (i: 1 to n) and the common electrodes Xi (i: 1 to n) formed at the inner surface of the front substrate 10 (one of the pair of substrates); and the dielectric layer 15 covering the surface-discharge electrode pairs with respect to the discharge space 16. The extraction electrode portions Yc of the scanning electrodes Yi are led to the end portion 11 of one side of the front substrate 10 and the extraction electrode portions Xc of the common electrodes Xi are led to the end portion 12 of the other side of the front substrate 10. The island-shaped assembly electrode terminal portion 13 that commonly connects the extraction electrode portions Xc of the common electrodes Xi is disposed. The plural micro openings 14 are disposed in the assembly electrode terminal portion 13 to form a mesh. Thus, occurrences of cracks in the assembly electrode terminal portion 13, which is a wide solid electrode, can be suppressed, the reliability of the terminals can be improved and yield at the time of manufacture can be improved.

Also, although it is necessary to narrow the width of the solid portion of the assembly electrode terminal portion 13 as a measure to counter cracks in a case where it is made into a solid terminal, this is not necessary in the present embodiment and resistance does not have to be raised. Also, due to the fact that the common electrodes X1 to Xn are all short-circuited to the assembly electrode terminal portion 13, a difference in luminance between display lines that occurs in a case where they are made into independent terminals does not occur.

It should be noted that, although an example was described in the aforementioned embodiment where the metal bus electrode portions Xb and Yb were connected to the T-shaped transparent electrode portions Xa and Ya in the structure of the surface-discharge electrode pairs (the common electrodes Xi and the scanning electrodes Yi), the shape of the surface-discharge electrode pairs (the common electrodes Xi and the scanning electrodes Yi) is not limited thereto and may be any shape as long as the present invention can be achieved.

What is claimed is:

1. A plasma display panel comprising:

a pair of substrates disposed to face each other, with a discharge space sandwiched therebetween;

a plurality of surface-discharge electrode pairs including scanning electrodes and common electrodes formed at an inner surface of one of the pair of substrate; and a dielectric layer covering the surface-discharge electrode pairs with respect to the discharge space, wherein:

extraction electrode portions of the scanning electrodes are led to an end portion of one side of the one substrate;

extraction electrode portions of the common electrodes are led to an end portion of the other side of the one substrate, an island-shaped assembly electrode terminal portion that commonly connects the extraction electrode portions of the common electrodes is disposed; and a plurality of micro openings are defined in the assembly electrode terminal portion.

2. The plasma display panel of claim 1, wherein:

the scanning electrodes and the common electrodes each includes a transparent electrode portion and a bus electrode portion that includes a metal layer laminated on the transparent electrode portion; and the extraction electrode portions and the assembly electrode terminal portion are formed by leading only the bus electrode portions to the end portion of the substrate.

3. The plasma display panel of claim 1, wherein:

the bus electrode portions, the extraction electrode portions and the assembly electrode terminal portion are formed by transferring and patterning , to the substrate, a conductive sheet in which a conductive paste including metal powder is made into a sheet, and patterning.

4. The plasma display panel of claim 2, wherein:

the bus electrode portions, the extraction electrode portions and the assembly electrode terminal portion are formed by transferring and patterning , to the substrate, a conductive sheet in which a conductive paste including metal powder is made into a sheet, and patterning.

5. A method for manufacturing a surface-discharge electrode pair, the method comprising:

depositing an transparent electrode material on a substrate;

forming a pattern of transparent electrode portions on the transparent electrode material;

transferring a conductive sheet onto the transparent electrode material; and forming patterns on the conductive sheet, bus electrode portions, extraction electrode portions and an assembly electrode terminal portion, wherein:

the extraction electrode portions include two groups of electrode portions; and one of the two groups of electrode portions extend to one side of the substrate; and the other of the two groups of electrode portions extend to the other side of the substrate.

* * * * *